US007488224B1

(12) United States Patent
Strickland, Jr.

(10) Patent No.: US 7,488,224 B1
(45) Date of Patent: Feb. 10, 2009

(54) SINGLE POLE CABLE CONNECTOR

(75) Inventor: Carl Craig Strickland, Jr., Kinston, NC (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 11/955,953

(22) Filed: Dec. 13, 2007

(51) Int. Cl.
*H01R 9/24* (2006.01)

(52) U.S. Cl. ..... 439/889; 439/737

(58) Field of Classification Search ..... 439/332, 439/333, 737, 738, 750, 889
See application file for complete search history.

(56) References Cited

U.S. PATENT DOCUMENTS 3,109,690 A 11/1963 Stevens, Jr. ..... 339/60
3,143,384 A * 8/1964 Senior, Jr. ..... 439/282
3,226,667 A * 12/1965 Senior, Jr. ..... 439/282
3,662,296 A 5/1972 Newman ..... 339/36
3,681,742 A 8/1972 Newman ..... 339/213
3,784,964 A * 1/1974 Newman et al. ..... 439/603
4,702,539 A * 10/1987 Cusick et al. ..... 439/588
5,366,392 A * 11/1994 Raloff et al. ..... 439/889
6,309,258 B1 10/2001 Measley ..... 439/738
7,077,681 B2 * 7/2006 Behoo ..... 439/333

* cited by examiner

*Primary Examiner*—Thanh-Tam T Le
(74) *Attorney, Agent, or Firm*—King & Spalding LLP

(57) ABSTRACT

A single pole cable connector includes an insulating sleeve defining a channel having at least a non-circular portion, and a non-circular contact positioned in the non-circular portion of the channel. The insulating sleeve may further include a non-circular, nonmetallic locking sleeve defining the non-circular portion of the channel. The channel and contact may be hexagonal-shaped in some embodiments. Single pole cable connector systems include male and female single pole cable connector of the present invention in mating engagement.

26 Claims, 10 Drawing Sheets

SINGLE POLE CABLE CONNECTOR

BACKGROUND OF THE INVENTION

The application relates generally to single pole cable connectors.

Single pole connectors are used to connect two lengths of wire or cable, for example, to provide cable to ships when shored. Known single pole connectors typically use a retention mechanism, such as a spring finger, to secure a circular contact attached to an electrical cable within an insulating sleeve of the connector. However, once the contact is inserted and locked into the insulating sleeve with the spring finger, the assembly becomes permanent and if the insulating sleeve is damaged in service, the complete connector, sleeve, and contact must be replaced. In addition, the design of conventional single pole connectors may allow the circular contact to slip and rotate within the insulator sleeve under certain conditions, thus making it difficult to disengage the contact without cutting the sleeve apart. Furthermore, some conventional insulating sleeves may include a thermoset rubber, such as a neoprene/hypalon rubber compound, as well as a metallic locking ring within the sleeve. As rubber sleeves are prone to abrasion, the current carrying metallic locking ring may be exposed when the sleeve splits or tears, thus potentially creating an unsafe environment for a user.

SUMMARY OF THE INVENTION

The present invention satisfies the above-described need by providing a single pole cable connector having an insulating sleeve and a contact. The insulating sleeve defines an inner channel, wherein at least a portion of the inner channel has a non-circular cross-section. The contact is positioned within the inner channel and includes a non-circular portion sized to fit within the portion of the inner channel having a non-circular cross-section. In some embodiments, the portion of the inner channel having a non-circular cross-section and at least a portion of the contact have hexagonal cross-sections. In some embodiments, at least a portion of the insulating sleeve has a hexagonal cross-section. In some instances, a nonmetallic, non-circular locking sleeve may be included. The locking sleeve is positioned within the insulating sleeve and defines the portion of the inner channel having a non-circular cross-section. In some embodiments, the at least a portion of the locking sleeve may have a hexagonal cross-section. In some embodiments, a threaded opening configured to receive a nonconductive screw may be included in the insulating sleeve, locking sleeve, and non-circular portion of the contact.

Single pole cable connector systems are also provided, wherein a single pole cable connector of the present invention is included. Generally, single pole cable connector systems of the present invention include a male single pole cable connector and a female single pole cable connector designed for mating engagement. The male connector includes a first insulating sleeve and a male contact. The first insulating sleeve defines a first inner channel, wherein at least a portion of the first inner channel has a non-circular cross-section. The male contact is positioned within the first inner channel and includes at least a non-circular portion sized to fit within the portion of the first inner channel having a non-circular cross-section. The female connector includes a second insulating sleeve and a female contact. The second insulating sleeve defines a second inner channel, wherein at least a portion of the second inner channel has a non-circular cross-section. The female contact is configured to mate with the male contact and is positioned within the second inner channel. The female contact also includes at least a non-circular portion sized to fit within the portion of the second inner channel having a non-circular cross-section.

In some embodiments, a portion of the first inner channel and at least a portion of the male contact have hexagonal cross-sections. In some embodiments, at least a portion of the first insulating sleeve has a hexagonal cross-section. In some embodiments, the male connector may further include a first nonmetallic, non-circular locking sleeve positioned in the first insulating sleeve and defining the portion of the first inner channel having a non-circular cross-section. In some embodiments, at least a portion of the first locking sleeve may have a hexagonal cross-section. In some embodiments, the first insulating sleeve, first locking sleeve, and first non-circular portion of the male contact include a threaded opening configured to receive a nonconductive screw.

In some embodiments, a portion of the second inner channel and at least a portion of the female contact have hexagonal cross-sections. In some embodiments, at least a portion of the second insulating sleeve has a hexagonal cross-section. In some embodiments, the female connector may further include a second nonmetallic, non-circular locking sleeve positioned in the second insulating sleeve and defining the portion of the second inner channel having a non-circular cross-section. In some embodiments, at least a portion of the second locking sleeve may have a hexagonal cross-section. In some embodiments, the second insulating sleeve, second locking sleeve, and second non-circular portion of the female contact include a threaded opening configured to receive a nonconductive screw.

These and other aspects, features and embodiments of the present invention will become apparent to those skilled in the art upon consideration of the following detailed description of illustrated embodiments exemplifying the best mode for carrying out the invention as presently perceived.

BRIEF DESCRIPTION OF THE DRAWINGS

FIG. 8B is a side view of the male connector shown in FIG. 1A and the female connector shown in FIG. 5A engaged, with a portion being a cross-sectional view illustrating the internal engagement.

Figure 1A:
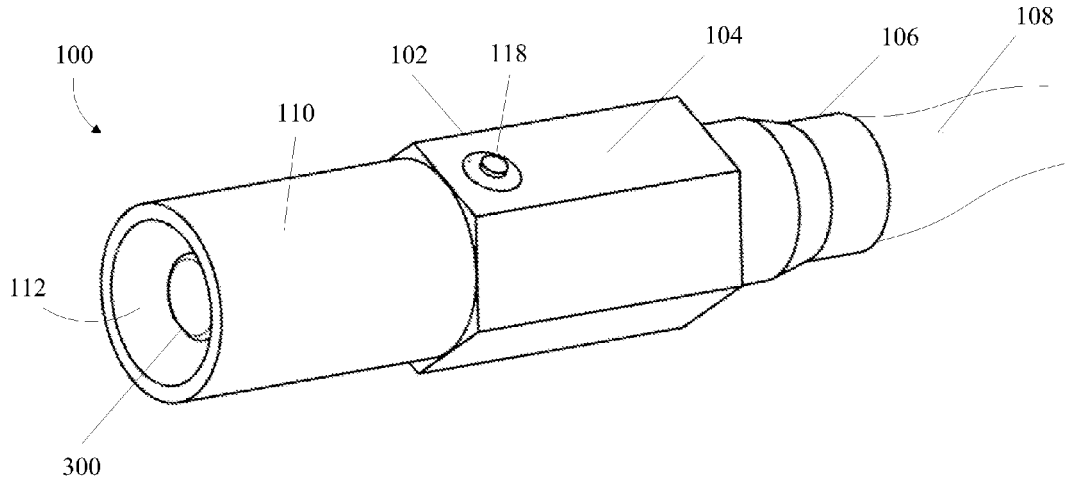
FIG. 1A is a perspective view of an exemplary male connector.
Figure 1B:
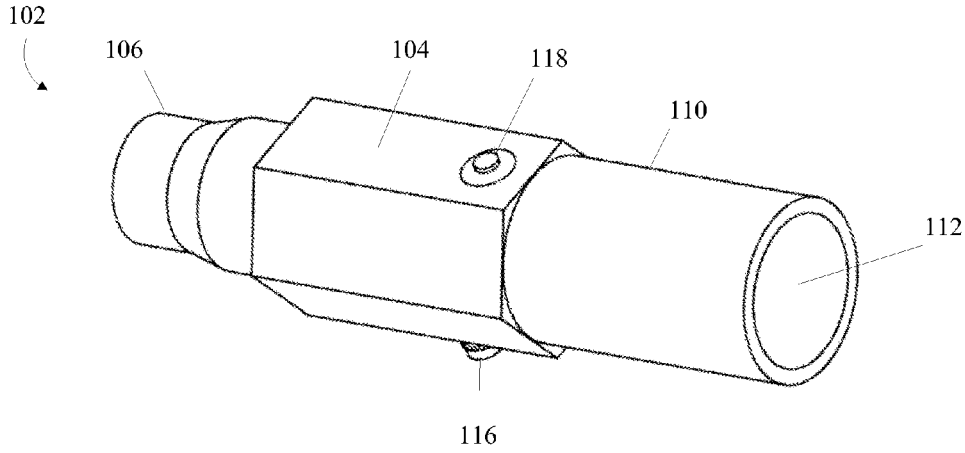
FIG. 1B is a perspective view of an exemplary insulating sleeve of the male connector shown in FIG. 1A.
Figure 1C:
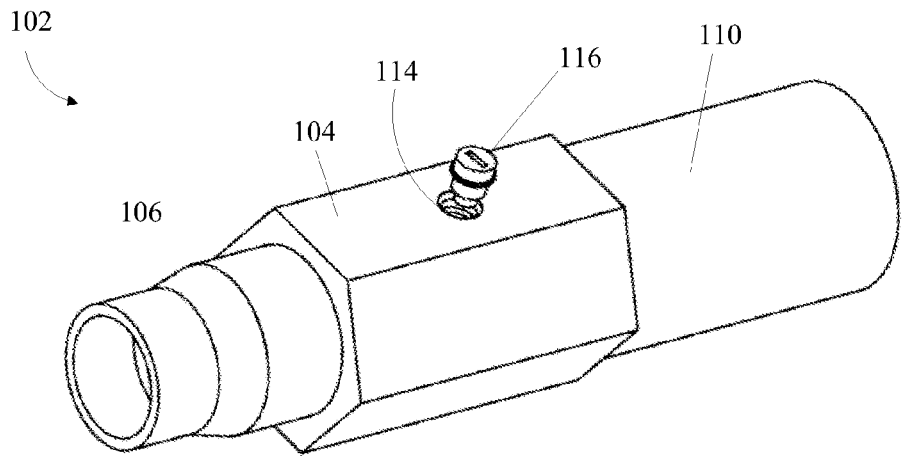
FIG. 1C is an alternate perspective view of the insulating sleeve shown in FIG. 1B.
Figure 1D:
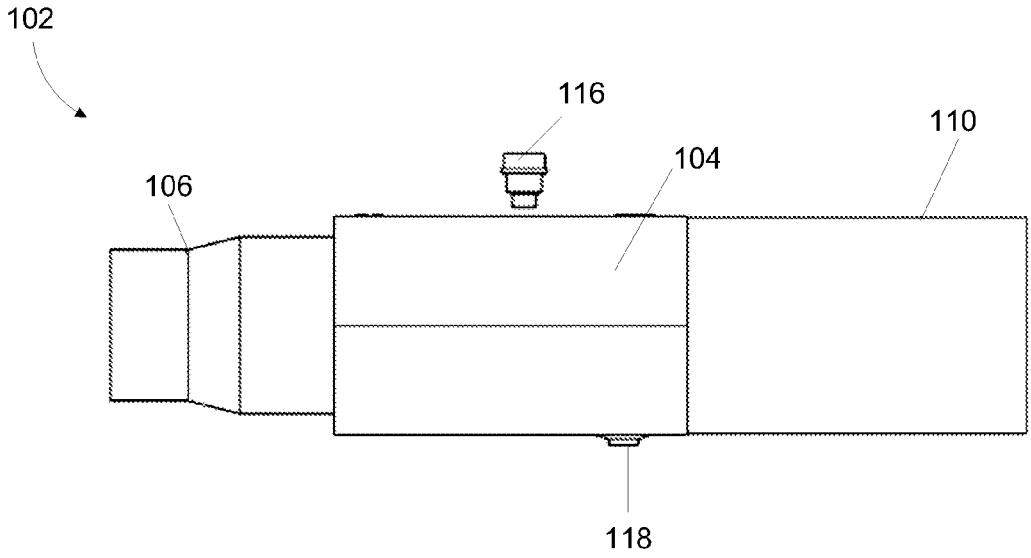
FIG. 1D is a side view of the insulating sleeve shown in FIG. 1B.

The appended drawings illustrate certain exemplary embodiments of the present invention and are therefore not to be considered limiting of its scope, as the invention may admit to other equally effective embodiments.

DETAILED DESCRIPTION OF THE INVENTION

The present invention may be better understood by reading the following description of non-limitative embodiments with reference to the attached drawings wherein like parts of each of the several figures are identified by the same reference characters, and which are briefly described as follows.

Referring to FIGS. 1A-1D, a male connector 100 includes an insulating sleeve 102. The insulating sleeve 102 is made from an insulating material, such as thermoplastic material. The sleeve 102 is generally cylindrical but includes a hexagonal-shaped central portion 104. The central portion 104 may be grasped, such as by a wrench, to manipulate the connector 100. While central portion 104 is hexagonal-shaped in the illustrated embodiment, in alternate embodiments, it may be configured to have any number of other shapes so long as sufficient gripping surfaces are provided. The sleeve 102 also includes a tapered end 106 from which an insulated cable 108 extends. The tapered end 106 has a smaller width or diameter than the central portion 104, and may be tapered stepwise or gradually from the central portion 104. The tapered end 106 is positioned on the opposite of central portion 104 as a cylindrical connection portion 110. The connection portion 110 has an open end 112 that permits access to a conductive contact 300 (See FIG. 3) and interacts with a connection portion of, for example, a mating connector or a supply panel to isolate the contact 300 from the external environment. In some embodiments, the connection portion 110 may have a ball nose (not shown), while in other embodiments, the connection portion 110 may have a slight tapered nose (as shown in the Figures). The central portion 104 includes an opening 114 through which a nonconductive screw 116 may be accessed. In some embodiments, the nonconductive screw 116 may be a nylon screw. The screw 116 secures the contact 300 in place within the sleeve 102. The insulating sleeve 102 also includes a release mechanism (or lock release button) 118 and allows for removal of the sleeve 102 and reuse of the male connector 100.

Figure 2A:
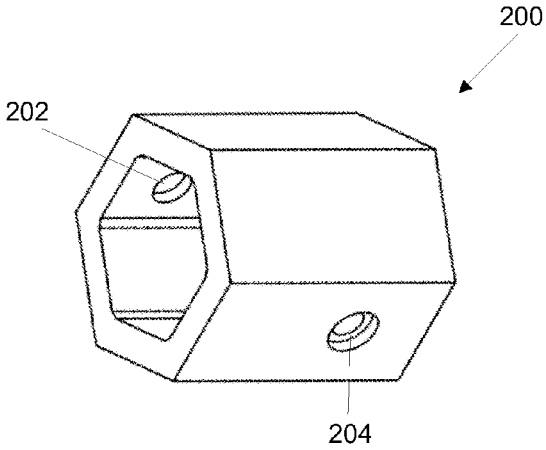
FIG. 2A is a perspective view of an exemplary locking sleeve of the male connector shown in FIG. 1A.
Figure 2B:
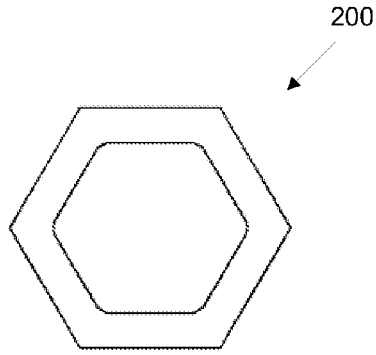
FIG. 2B is a front view of the locking sleeve shown in FIG. 2A.
Figure 2C:
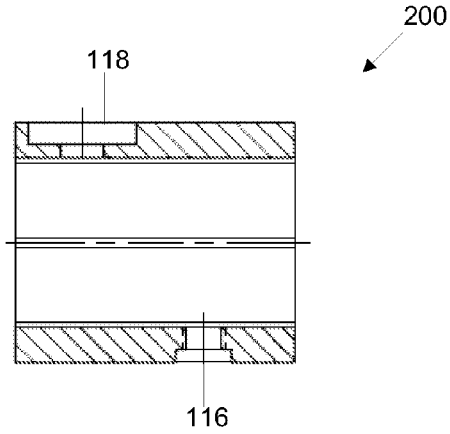
FIG. 2C is a side cross-sectional view of the locking sleeve shown in FIG. 2A.

Referring to FIGS. 2A-2C, the connector 100 contains a hexagonal-shaped locking sleeve (or locking ring) 200 positioned within the sleeve 102 in the region defined by the central portion 104. The locking sleeve 200 defines a central channel sized to receive a contact (not shown). The locking sleeve 200 is nonmetallic and thus provides a safer environment for a user in the instance that the insulating sleeve 102 is compromised. Suitable examples of nonmetallic materials for constructing the locking sleeve 200 include, but are not limited to, polypropylene, glass fibers, and the like. The locking sleeve 200 includes an opening 202 that aligns with opening 114 of sleeve 102, through which nonconductive screw 116 may be accessed. The locking sleeve also includes an opening 204 through which the release mechanism 118 may be accessed.

Figure 3A:
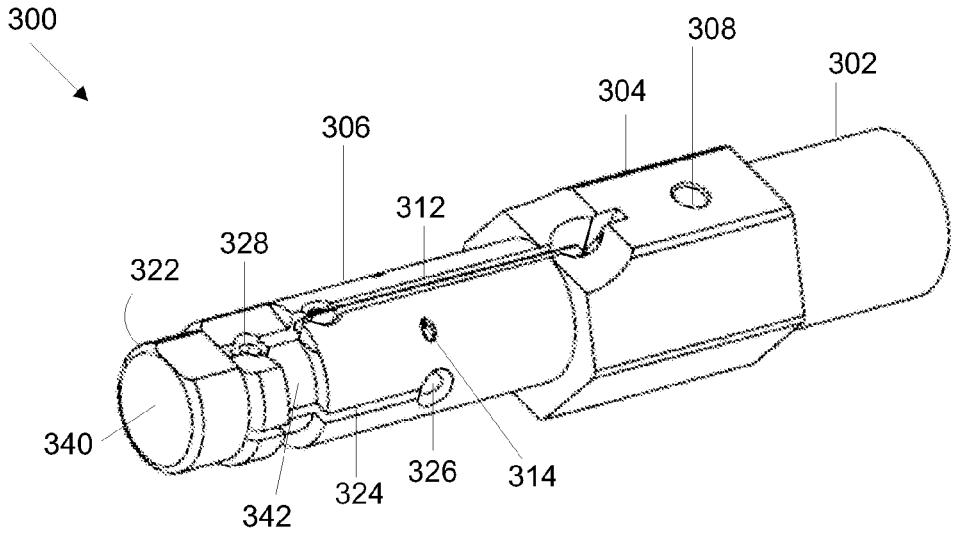
FIG. 3A is a perspective view of an exemplary male contact of the male connector shown in FIG. 1A.
Figure 3B:
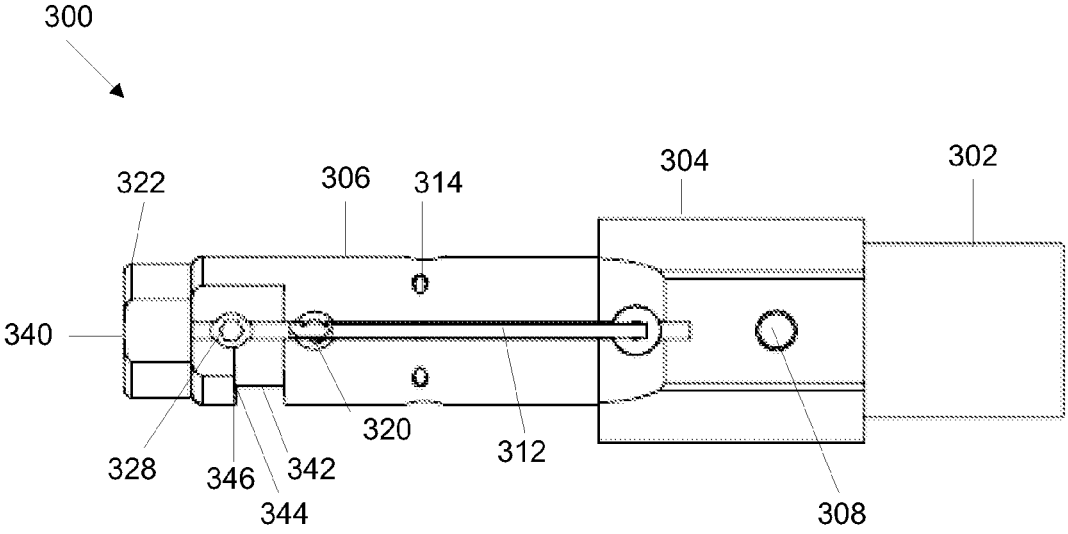
FIG. 3B is a top view of the male contact shown in FIG. 3A.
Figure 3C:
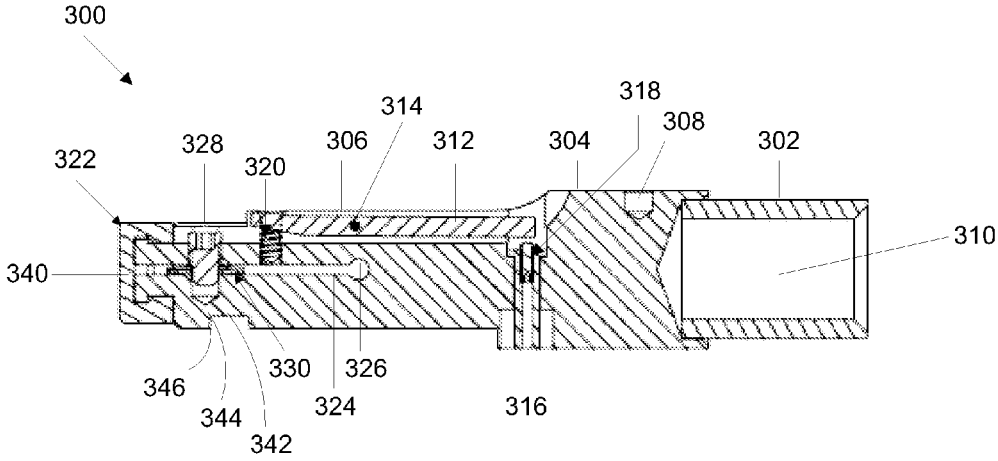
FIG. 3C is a side cross-sectional view of the male contact shown in FIG. 3A.

Referring to FIGS. 3A-3C, an exemplary embodiment of a contact 300 for use with male connector 100 includes a generally cylindrical body 302 having a hexagonal-shaped portion 304 from which extends a generally cylindrical connection portion 306. The hexagonal-shaped portion 304 locks within the locking sleeve 200 and includes a locking hole 308 through which screw 116 is engaged to aid in preventing axial movement of the contact 300 within the connector 100. The hexagonal shape of the portion 304 also locks the contact 300 in place and prevents rotational movement within the connector 100. In alternate embodiments, the portion 304 may be configured in any number of other shapes, so long as the anti-rotational torque is improved over a circular configuration. The body 302 and hexagonal-shaped portion 304 define a channel 310 along most of its length. In use, an electrical cable is positioned in the channel 310 and may be secured in place by crimping or soldering. In other embodiments, the cable may be secured using set screws or other securing implementations. One of skill in the art will recognize alternate means for securing a cable in place. The contact 300 may be made from any conductive material. Suitable examples of conductive materials include, but are not limited to, copper, copper alloys, and brass. In some embodiments, the contact 300 may be plated with silver, silver alloy, nickel, and/or a tarnish resistant treatment.

Contact 300 includes a latch mechanism used in securing the contact 300 into position after engagement and prevents accidental disengagement with a mating contact. The latch mechanism includes a locking latch 312, spirol pin 314, latch plunger pin 316, plunger pin set screw 318, and spring 320. Locking latch 312 is positioned along the length of the connection portion 306 from the hexagonal-shaped portion 304 to just before the tip 322 of the connection portion 306. Spirol pin 314 provides a pivot for the locking latch 312. Locking latch 312 is in contact with plunger pin set screw 318 and latch plunger pin 316 which is in contact with release mechanism 118. At the opposite end of the locking latch 312, the locking latch 312 is in contact with spring 320, which aids in the locking the male contact 300 together with a mating contact. Spring 320 provides tension on the latch 312 tip to keep it extended in the locked position, while allowing the latch 312 tip to retract as necessary during the engaging of male and female contacts.

The connection portion 306 has a smaller diameter than the body 302. The connection portion 306 includes a gap (or slot) 324 that extends from the tip 322 of the connection portion 306 to a hole 326 in the connection portion 306. When adjusted by set screw 328, disk spring 330 provides a resistance to inward flexing of contact members and insures a tight, reliable fit between male and female contacts. The gap 324 allows for expansion or contraction of the diameter of the contact 300 as the set screw 328 is adjusted to give optimal contact with a mating female contact.

Tip 322 of the connection portion 306 is an insulator affixed to the end of the connection portion 306 to minimize the risk of inadvertent contact with an electrically live disengaged contact. The tip 322 is circular with a flattened section 340. The flattened section 340 extends a short distance along the length of the connection portion 306 until it terminates in a circumferential groove 342 that extends partially around the circumference of the connection portion 306. In use, the flattened section 340 permits insertion of the end tip 340 into a similarly-shaped opening in a mating contact. The contacts are then rotated relative to each other until the lip 344 is between the circumferential groove 342 and the tip 322 locks with the corresponding circumferential groove in the mating contact. Thereafter, a front wall 346 of the groove 342 prevents axial movement of the contacts relative to each other.

Figure 4:
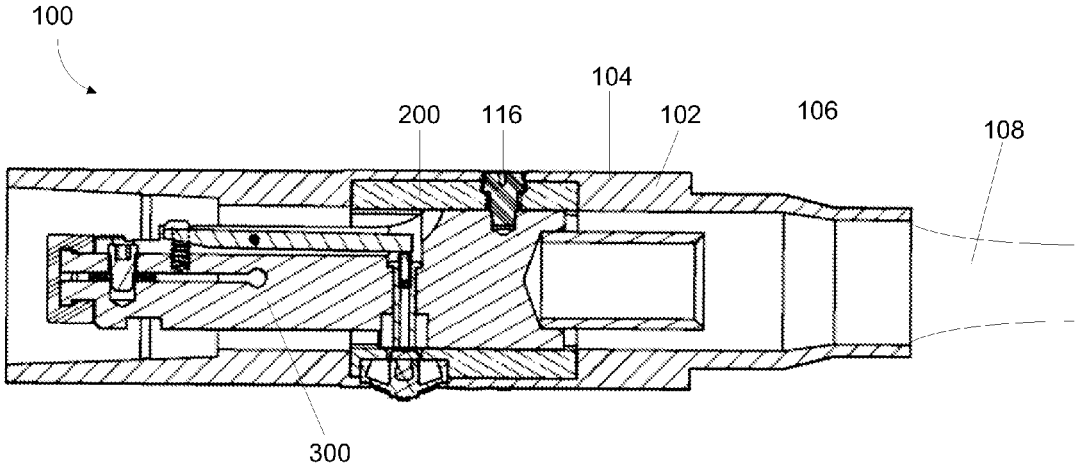
FIG. 4 is a side cross-sectional view of the male connector shown in FIG. 1A.

Referring to FIG. 4, assembly of the male connector 100 begins with insertion of the electrical cable 108 into the tapered end 106 of the insulating sleeve 102 until the cable 108 extends from the end 106. Prior to insertion, the insulation surround the conductive elements of the cable 108 must be stripped from the end of the electrical cable 108 to expose the conductive elements. The conductive elements are placed in the channel 310 of the contact 300 and secured via crimping or other mechanism known in the art. Once the contact 300 is attached to the end of the electrical cable 108, the electrical cable 108 is pulled back into the insulating sleeve 102. The contact 300 is pushed into the sleeve 102 such that the locking hole 308 is aligned with openings 114 and 202 of the central portion 104 of insulating sleeve 102 and locking sleeve 200, respectively. The screw 116 is then inserted into openings 114 and 202, and locking hole 308 to lock the contact 300 in place and prevent axial motion of the contact 300 relative to the sleeve 102.

Figure 5A:
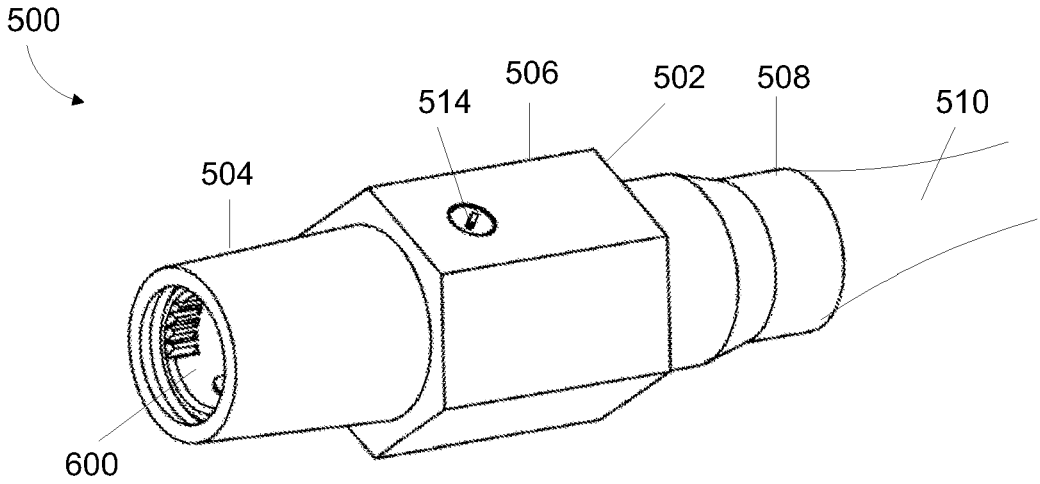
FIG. 5A is a perspective view of an exemplary female connector.
Figure 5B:
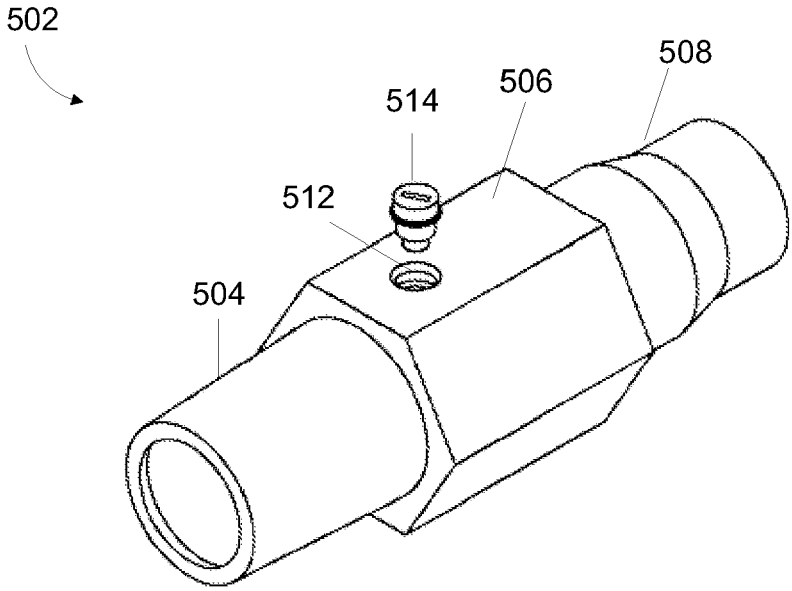
FIG. 5B is a perspective view of an exemplary insulating sleeve of the female connector shown in FIG. 5A.
Figure 5C:
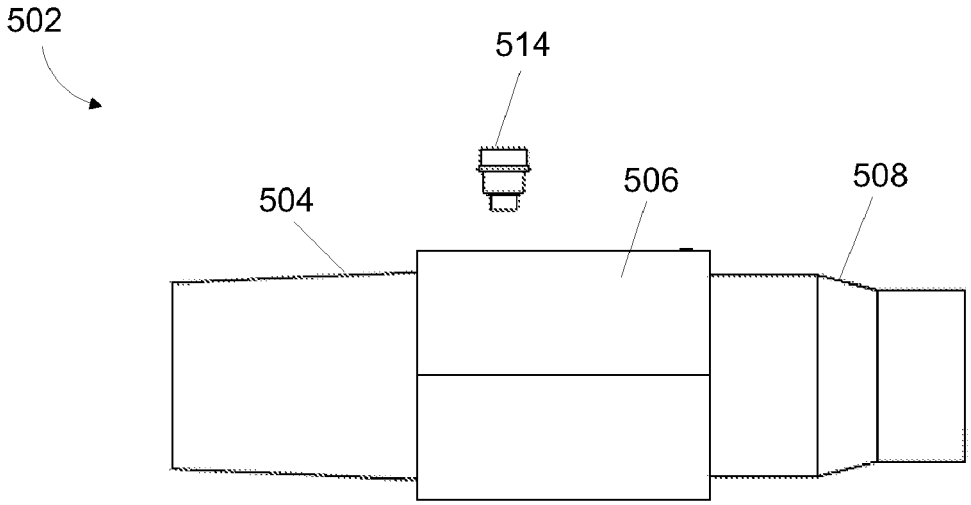
FIG. 5C is a side view of the insulating sleeve shown in FIG. 5B.
Figure 5D:
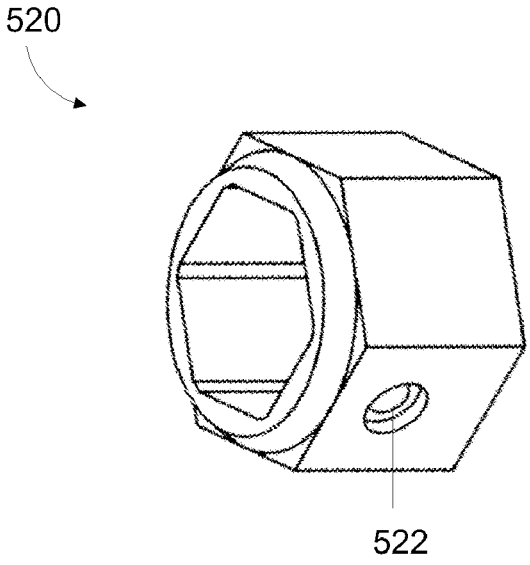
FIG. 5D is a perspective view of an exemplary locking sleeve of the female connector shown in FIG. 5A.

Referring to FIGS. 5A-5C, a female connector 500 for use with the male connector 100 includes an insulating sleeve 502 that is similar in shape and operation to the insulating sleeve 102 of the connector 100. The sleeve 502 differs in that it includes a connection portion 504 that is of smaller diameter than the connection portion 110 of the sleeve 102, and is sized to be received within the connection portion 110. The sleeve 502 also does not include a release mechanism. The sleeve 502 is generally cylindrical and includes a hexagonal-shaped central portion 506. The central portion 506 is grasped to manipulate the connector 500. While central portion 506 is hexagonal-shaped as shown in the figures, in alternate embodiments, the central portion 506 may be configured any number of ways so long as gripping surfaces are provided. The sleeve 502 also includes a tapered end 508 from which an insulated cable 510 extends. The tapered end 508 has a smaller width or diameter than the central portion 506, and may be tapered stepwise or gradually (not shown) from the central portion 506. The tapered end 508 is positioned opposite the cylindrical connection portion 504. The connection portion 504 has an open end that permits access to a conductive contact 600 and interacts with a connection portion of a mating male connector. In some embodiments, the connection portion 504 may have a ball nose (not shown), while in other embodiments, the connection portion 504 may have a tapered nose (shown in the Figures). The central portion 506 includes an opening 512 through which a nonconductive screw 514 may be accessed. In some embodiments, the nonconductive screw 514 may be a nylon screw. The screw 514 secures the contact 600 in place within the sleeve 502. Referring to FIG. 5D, the connector 500 includes a locking sleeve 520 that operates in the same manner as the locking sleeve 200. Locking sleeve 520 includes an opening 522 through which screw 514 may be accessed.

Figure 6A:
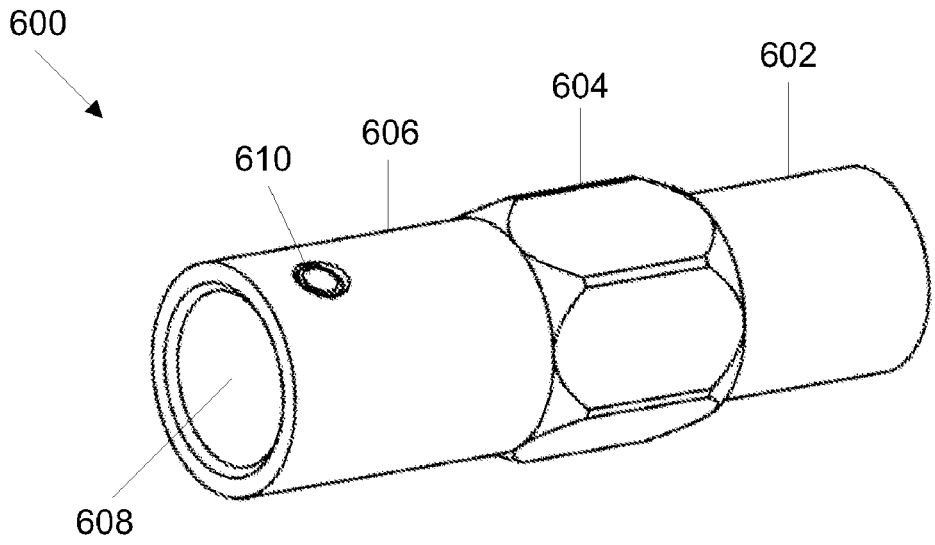
FIG. 6A is a perspective view of an exemplary female contact of the female connector shown in FIG. 5A.
Figure 6B:
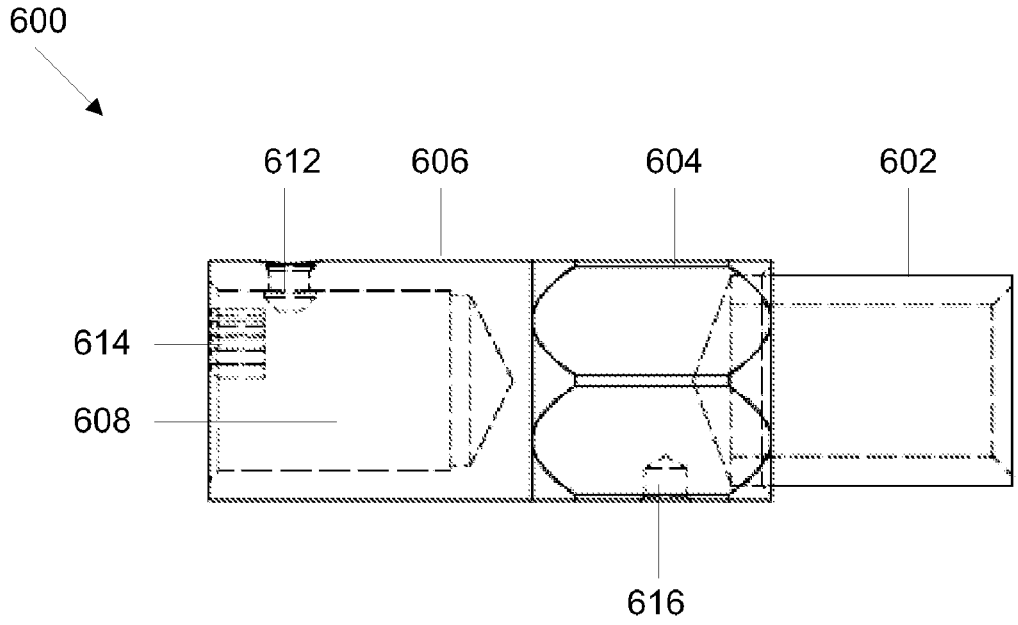
FIG. 6B is a side view of the female contact shown in FIG. 6A.
Figure 6C:
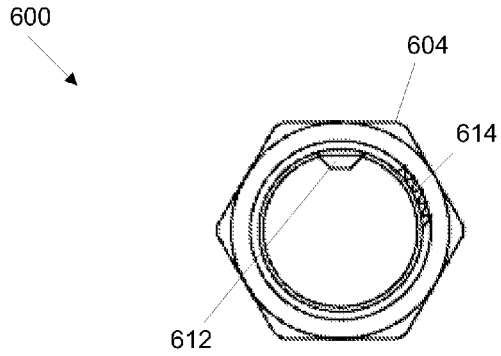
FIG. 6C is a front view of the female contact shown in FIG. 6A.

Referring to FIGS. 6A-6C, contact 600 of the connector 500 is configured similarly to the contact 300 of the connector 100. Contact 600 includes a generally cylindrical body 602 having a hexagonal-shaped portion 604 from which extends a generally cylindrical connection portion 606. The body 602 and hexagonal-shaped portion 604 are generally physically and functionally similar to body 302 and hexagonal-shaped portion 304, but the contacts differ in that the contact 600 includes a connection portion 606 that is configured differently from connection portion 306. The connection portion 606 is substantially cylindrical and defines a channel 608 that is sized to receive the connection portion 306 of male contact 300. The connection portion 606 includes an opening 610 for a rivet 612 to be accessed and lock the connection portion 306 of male contact 300 when inserted. The rivet 612 is designed to engage groove 342 of male contact 300. The connection portion also includes slots (or broached teeth) 614 to aid in securing the male contact 300 in place. The latch mechanism of contact 300 engages one of the slots 614 and locks the male contact 300 and female contact 600 together and prevents accidental disengagement. In an exemplary embodiment, the contact 300 may include five slots 614. Hexagonal-shaped portion 604 includes a locking hole 616 to receive screw 514. While the illustrated portion 604 is hexagonal-shaped, in alternate embodiments, the portion 604 may be configured in any number of other shapes, so long as the anti-rotational torque is improved over a circular configuration.

Figure 7:
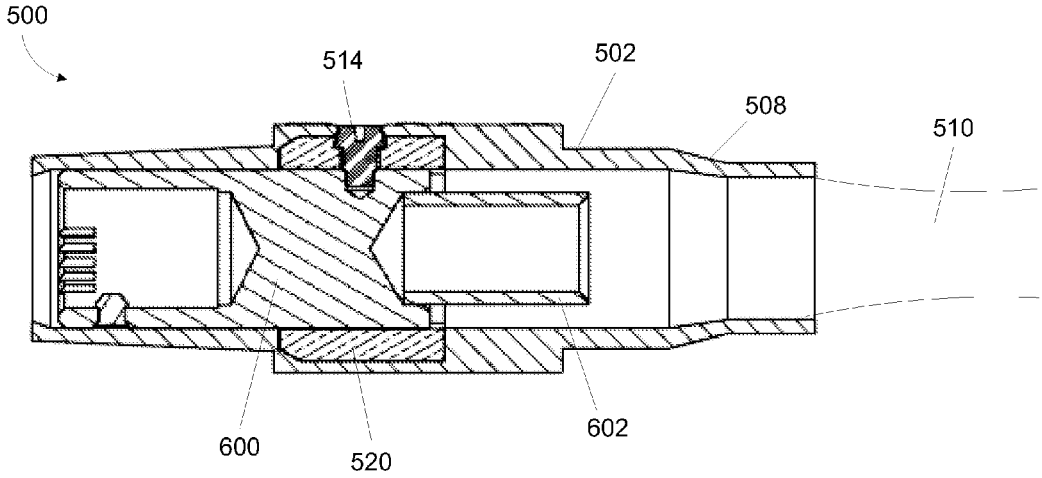
FIG. 7 is a side cross-sectional view of the female connector shown in FIG. 5A.

Referring to FIG. 7, assembly of the female connector 500 begins with insertion of the electrical cable 510 into the tapered end 508 of the insulating sleeve 502 until the cable 510 extends from the end 508. Prior to insertion, the insulation surround the conductive elements of the cable 510 must be stripped from the end of the electrical cable 510 to expose the conductive elements. The conductive elements are placed in the channel defined by body 602 of contact 600 and secured via crimping or other mechanism known in the art. Once the contact 600 is attached to the end of the electrical cable 510, the electrical cable 510 is pulled back into the insulating sleeve 502. The contact 600 is pushed into the sleeve 502 such that the locking hole 616 of the contact 600 is aligned with openings 512 and 522 of the central portion 506 of insulating sleeve 502 and locking sleeve 520, respectively. The screw 514 is then inserted into openings 512 and 522, and locking hole 616 to lock the contact 600 in place and prevent axial motion of the contact 600 relative to the sleeve 502.

Figure 8A:
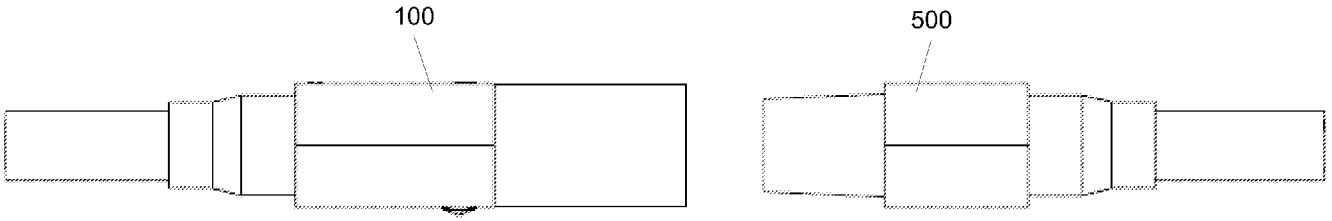
FIG. 8A is a side view of the male connector shown in FIG. 1A and the female connector shown in FIG. 5A disengaged.
Figure 8B:
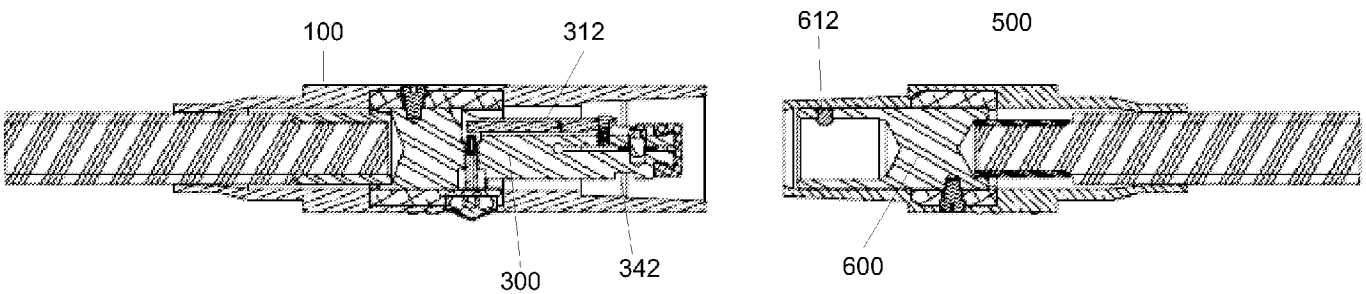
FIG. 8B is a side cross-sectional view of the male connector shown in FIG. 1A and the female connector shown in FIG. 5A disengaged.
Figure 8C:
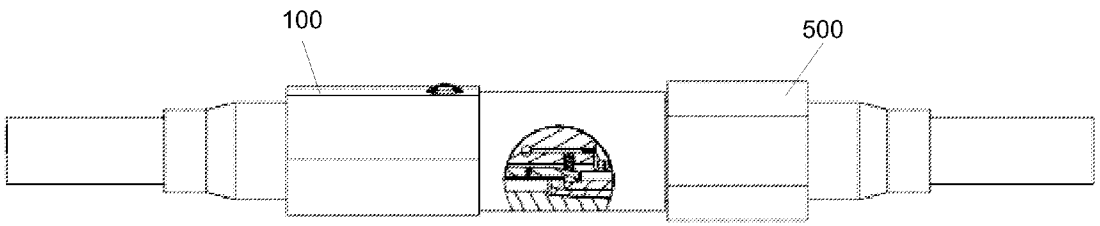

FIGS. 8A-8C illustrate engagement of male connector 100 and female connector 500. Male contact 300 is placed in female contact 600 and then rotated such that rivet 612 of female contact 600 locks with the circumferential groove 342 that extends partially around the circumference of the connection portion 306 of male contact 300. Additionally, the locking latch 312 of contact 300 engages one of the slots 614 of female contact 600 and further locks the male contact 300 and female contact 600 together.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Having described some exemplary embodiments of the present invention, it is believed that the use of alternate contact configurations for mating contact engagement is within the purview of those in the art. Additionally, while the present application discusses hexagonal-shaped contacts, locking sleeves, and insulating sleeves, it is understood that a number of other non-circular configurations may be used based on the anti-rotational torque desired. While numerous changes may be made by those skilled in the art, such changes are encompassed within the spirit of this invention as defined by the appended claims. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. The terms in the claims have their plain, ordinary meaning unless otherwise explicitly and clearly defined by the patentee.

What is claimed is:

1. A single pole cable connector, comprising:

an insulating sleeve defining an inner channel and having an exterior surface, at least a portion of the inner channel having a first non-circular cross-section, and at least a portion of the exterior surface having a second non-circular cross-section wherein the second non-circular cross-section comprises a plurality of flat sides adjacent to each other; and a contact comprising a portion having a non-circular cross-section that is sized to fit within the portion of the inner channel having the first non-circular cross-section.

2. The connector of claim 1, wherein the first and second non-circular cross-sections are hexagonal shape.

3. The connector of claim 1, wherein at least a portion of the insulating sleeve has a hexagonal cross-section.

4. The connector of claim 1, further comprising a locking sleeve positioned in the insulating sleeve and having an inner surface and an outer surface, wherein the inner surface of the locking sleeve defines the portion of the inner channel having the first non-circular cross-section.

5. The connector of claim 4, wherein the locking sleeve is nonmetallic.

6. The connector of claim 4, wherein the insulating sleeve, locking sleeve, and non-circular portion of the contact each include a threaded opening configured to receive a single screw therein.

7. The connector of claim 6, wherein the screw is nonconductive.

8. The connector of claim 1, wherein at least a portion of the inner channel of the insulating sleeve has a circular cross-section disposed at an opening of the inner channel and adjacent the first non-circular cross-section.

9. A single pole cable connector system, comprising:

a male connector comprising a first insulating sleeve defining a first inner channel and having a first exterior surface, at least a portion of the first inner channel having a first non-circular cross-section, and at least a portion of the first exterior surface having a second non-circular cross-section wherein the second non-circular cross-section comprises a plurality of flat sides adjacent to each other, and a male contact comprising a portion having a non-circular cross-section that is sized to fit within the portion of the first inner channel having the first non-circular cross-section;

a female connector comprising a second insulating sleeve defining a second inner channel and having a second exterior surface, at least a portion of the second inner channel having a third non-circular cross-section, and at least a portion of the second exterior surface having a fourth non-circular cross-section wherein the fourth non-circular cross-section comprises a plurality of flat sides adjacent to each other, and a female contact configured to mate with the male contact, the female contact comprising a portion having a non-circular cross-section that is sized to fit within the portion of the second inner channel having the third non-circular cross-section;

wherein the male connector and female connector are in mating engagement.

10. The system of claim 9, wherein the first and second non-circular cross-sections are hexagonal shape.

11. The system of claim 9, wherein at least a portion of the first insulating sleeve has a hexagonal cross-section.

12. The system of claim 9, further comprising a first locking sleeve positioned in the first insulating sleeve and having an inner surface and an outer surface, wherein the inner surface of the first locking sleeve defines the portion of the first inner channel having the first non-circular cross-section.

13. The system of claim 12, wherein the first locking sleeve is nonmetallic.

14. The system of claim 12, wherein the first insulating sleeve, first locking sleeve, and first non-circular portion of the male contact each include a threaded opening configured to receive a single screw therein.

15. The system of claim 14, wherein the screw is nonconductive.

16. The system of claim 9, wherein the third and fourth non-circular cross-sections are hexagonal shape.

17. The system of claim 9, wherein at least a portion of the second insulating sleeve has a hexagonal cross-section.

18. The system of claim 9, further comprising a second locking sleeve positioned in the second insulating sleeve and having an inner surface and an outer surface, wherein the inner surface of the second locking sleeve defines the portion of the second inner channel having the third non-circular cross-section.

19. The system of claim 18, wherein the second locking sleeve is nonmetallic.

20. The system of claim 18, wherein the second insulating sleeve, second locking sleeve, and second non-circular portion of the female contact each include a threaded opening configured to receive a single screw therein.

21. The system of claim 20, wherein the screw is nonconductive.

22. The system of claim 9, wherein at least a portion of the first inner channel of the first insulating sleeve has a circular cross-section disposed at an opening of the first inner channel proximate the second inner channel, wherein the circular cross-section is adjacent the first non-circular cross-section.

23. The system of claim 9, wherein at least a portion of the second inner channel of the second insulating sleeve has a circular cross-section disposed at an opening of the second inner channel proximate the first inner channel, wherein the circular cross-section is adjacent the third non-circular cross-section.

24. A single pole cable connector system comprising:

a male connector comprising a first insulating sleeve having a first exterior surface and defining a first inner channel, at least a portion of the first exterior surface having a non-circular cross-section wherein the non-circular cross-section comprises a plurality of flat sides adjacent to each other, and a male contact positioned within the first inner channel;

a female connector comprising a second insulating sleeve having a second exterior surface and defining a second inner channel, at least a portion of the second exterior surface having a non-circular cross-section wherein the non-circular cross-section comprises a plurality of flat sides adjacent to each other, and a female contact configured to mate with the male contact and positioned within the second inner channel;

wherein the male connector and female connector are in mating engagement.

25. The system of claim 24, wherein a first portion of the first inner channel has a non-circular cross-section, and a second portion of the first inner channel has a circular cross-section at an opening in mating engagement with the female connector.

26. The system of claim 24, wherein a first portion of the second inner channel has a non-circular cross-section, and a second portion of the second inner channel has a circular cross-section at an opening in mating engagement with the male connector.

* * * * *